US005954007A

United States Patent [19]

Durham

[11] Patent Number: 5,954,007

[45] Date of Patent: Sep. 21, 1999

[54] CATAMARAN FOR SAILING AND ROWING

[76] Inventor: Roger O. Durham, 1370 Thompson Ave., Glendale, Calif. 91201

[21] Appl. No.: 08/843,728

[22] Filed: Apr. 21, 1997

Related U.S. Application Data

[63] Continuation of application No. 08/364,945, Dec. 28, 1994, abandoned.

[51] Int. Cl.[6] ..... B63B 1/00

[52] U.S. Cl. ..... 114/61; 114/90

[58] Field of Search ..... 114/39.1, 61, 89–91, 114/102, 103, 352–354; 440/21, 101–106

[56] References Cited

U.S. PATENT DOCUMENTS

| | | | |
|---|---|---|---|
| 792,924 | 6/1905 | Postgate | 114/90 |
| 2,364,578 | 12/1944 | Wilkie | 114/90 |
| 3,524,422 | 8/1970 | Fuller | 114/39.1 |
| 4,068,611 | 1/1978 | Leather | 114/39.1 |
| 4,557,210 | 12/1985 | Gerwin | 114/61 |
| 4,570,562 | 2/1986 | Dudouyt | 114/39.1 |

*Primary Examiner*—Ed Swinehart

[57] ABSTRACT

A catmaran has a U-shaped mast, and either a triangular lateen sail, or a four-sided lug sail, and provisions for rowing, allowing the catamaran to be propelled either by sails or by oars.

3 Claims, 1 Drawing Sheet

CATAMARAN FOR SAILING AND ROWING

This application is a continuation of U.S. Pat. Ser. No. 08/364,945, filed Dec. 28, 1994, now abandoned.

FIELD OF THE INVENTION

This invention pertains to catamaran equipped for both sailing and rowing.

DESCRIPTION OF THE PRIOR ART

Because of their inherent stability, catamarans make ideal vessels for sailing. Occasionally, there, are used for rowing.

When used for sailing, usually they nave been designed to provide speed, rather than for ease of handling or convenience. This is particularly than for small catamarans.

One of the oldest, and probably one of the most simple sailing rigs is the triangular lateen sail, wherein a mast supports a yard to which this sail is secured.

Occasionally, two masts have been used to form an inverted 'V', with the yard supported at the apex of the V. This allows more freedom of movement for the yard and the sail, and it allows a lateen-sail equipped vessel to be more easily tacked into the wind.

Another simple sail is the four-sided lug sail, which is secured to a yard.

For efficient sculling, wherein a man uses two oars, the oars are supported in oarlocks which are about 5 feet apart. The oars are about 12 feet long, and their inboard ends usually overlap each other. The oarsman sits on a seat having rollers under it to allow him to move forward and backward, and his feet are strapped into pivoting footrests to allow him to pull himself toward the footrests during the return part of his stroke. Much of the rowing propulsion is provided by the oarsman's legs and back. His arms are usually straight, except at the end of the stroke, wherein they will be drawn up to his chest. At the end of his stroke, the oarsman is nearly fully extended and he occupies a space about six feet long.

Because of the spaced-apart oarlocks, and the space required for the oarsman, provision for rowing requires a substantial volume of space, and that makes it difficult to combine sculling and sailing qualities in one vessel However, by combining known elements in a unique way, the current invention does this very well, resulting in a sailing vessel which can be rowed out-of the harbor to open ocean, where the mast and sail can be raised, and the vessel can then proceed under sail. Or, the catamaran of the invention serves well for simply rowing both for recreation and exercise.

SUMMARY OF THE INVENTION:

According to the invention, catamaran has a pair of oarlocks mounted on its spaced-apart hulls. A 'U'-shaped mast is supported, directly or indirectly, by the hulls. The yard of a lateen sail rig is raised to the apex of the 'U'-shaped mast. Alternately, a lugsail rig can be used.

These elements work together. The spaced-apart hulls accomodate the oarlocks. The U shaped mast provides space beneath it for the oarsman and his movable seat. Also, the U shaped mast also allows room for the yard and the sail to swing freely from one side to the other without contact with the u-shaped mast, thus allowing the catamaran to be tacked into the wind. The four-sided lugsail is also accomodated by the u-shaped mast.

Only these elements work together. Substitute a single hull for the twin hulls; substitute a straight, centrally-located mast; or substitute another type of sail, and the combination suffers.

DETAILED DESCRIPTION OF THE DRAWINGS

Figure 1:
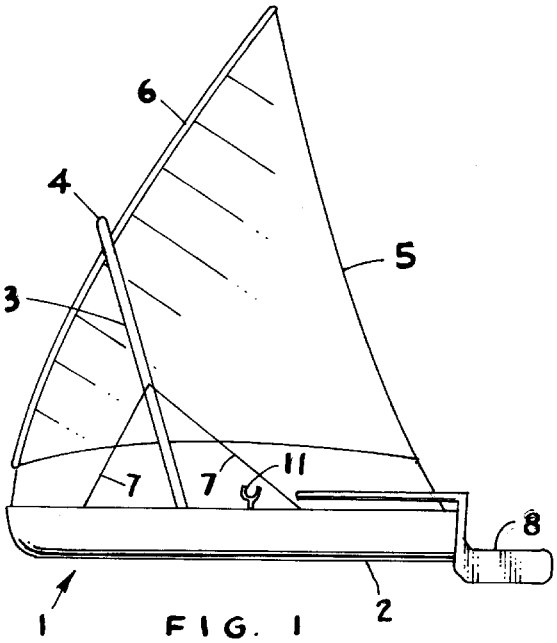
FIG. 1 shows a side view of the catamaran according to the invention, where said catamaran is under sail, with oars stowed
Figure 3:
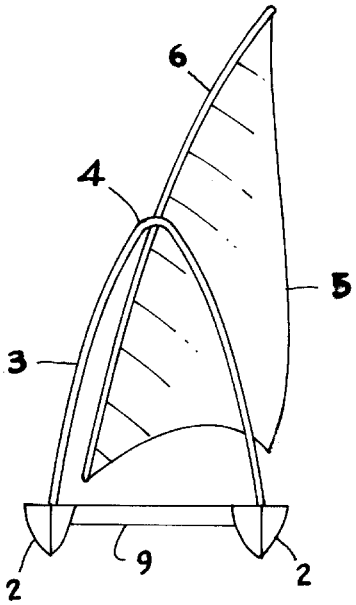
FIG. 3 is a view of the vessel under sail, taken along line 3—3 of FIG. 1, showing a graceful lateen sail deployed.
Figure 2:
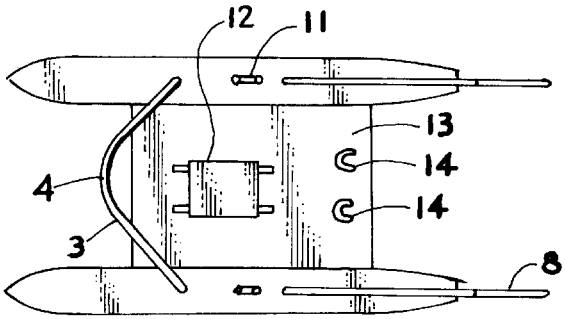
FIG. 2 shows a top view of the catamaran when it is being rowed, with the yard and sail stowed.
Figure 4:
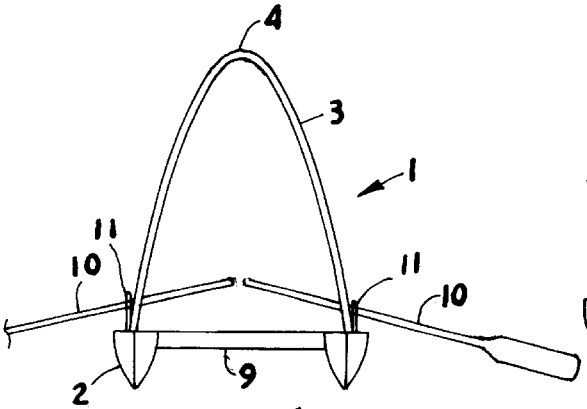
FIG. 4 is a rotated section taken along line 4—4 of FIG. 3, showing oars out and sail stowed.
Figure 5:
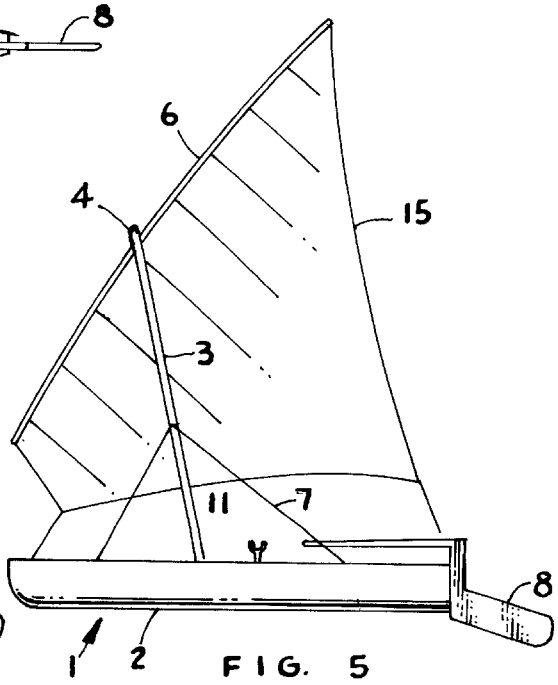
FIG. 5 is a side view of a catamaran according to the invention with a four sided sail.

Referring to the drawings, a catamaran 1 includes a pair of spaced-apart hulls 2, and an inverted U shaped mast 3 having an apex 4 at its top, from which the yard 6 of a lateen sail is suspended. A plurality of guys 7 maintain said u-shaped mast 3 in an upright position. One or more rudders 8 allow said catamaran vessel 1 to be steered. A center structure 9 is secured between said spaced-apart hulls 2. Said center structure 9 preferably includes a deck which in turn supports a pair of tracks 17 for a movable seat 12 for the oarsman. A foot support means 13 would usually include a foot retention means 14, such as velcro straps.

The inverted U shaped mast 3 can easily be pivoted, either backwards or forwards, to lie flat and thus reduce its windage. If laid forward, it might serve as a locating point for a parachute anchor for use in severe weather conditions. Partially layed back, it might serve as the frame of a canopy to shield the oarsman from the sun or rain.

MODE OF OPERATION

For rowing, the yard and sail are furled and stored on one of the hulls, with an oar passing above. The u-shaped mast may or may not be layed flat.

For sailing, the oars are stored on one or both hulls, and the yard and sail are hauled up to the apex of the u-shaped mast.

I claim:

1. A catamaran for sailing and rowing, comprising;

a) a pair of spaced-apart hulls and a deck interconnecting said hull's;

b) an inverted, u-shaped mast attached to said hulls and having an apex at its top c) a sail having a yard, said yard secured to said apex of said u-shaped mast;

d) a pair of spaced-apart oarlocks;

e) a foot support means secured to said deck;

f) a seats positioned on said deck.

2. Apparatus according to claim 1, wherein said sail is a triangular lateen sail.

3. Apparatus according to claim 1, wherein said sail is a 4-sided lug sail.

* * * * *